US011519432B2

(12) United States Patent
Wang et al.

(10) Patent No.: US 11,519,432 B2
(45) Date of Patent: Dec. 6, 2022

(54) METHOD OF ACTUATION USING KNIT-CONSTRAINED PNEUMATICS

(71) Applicant: THE REGENTS OF THE UNIVERSITY OF MICHIGAN, Ann Arbor, MI (US)

(72) Inventors: Wei-Chang Adam Wang, Ann Arbor, MI (US); Sean Ahlquist, Ann Arbor, MI (US)

(73) Assignee: THE REGENTS OF THE UNIVERSITY OF MICHIGAN, Ann Arbor, MI (US)

( * ) Notice: Subject to any disclaimer, the term of this patent is extended or adjusted under 35 U.S.C. 154(b) by 676 days.

(21) Appl. No.: 16/476,335

(22) PCT Filed: Jan. 9, 2018

(86) PCT No.: PCT/US2018/012946
§ 371 (c)(1),
(2) Date: Jul. 8, 2019

(87) PCT Pub. No.: WO2018/129521
PCT Pub. Date: Jul. 12, 2018

(65) Prior Publication Data

US 2022/0003251 A1 Jan. 6, 2022

Related U.S. Application Data

(60) Provisional application No. 62/443,938, filed on Jan. 9, 2017.

(51) Int. Cl.

| | |
|---|---|
| ***F15B 15/10*** | (2006.01) |
| ***D04B 1/10*** | (2006.01) |
| ***D04B 1/22*** | (2006.01) |

(52) U.S. Cl.
CPC ..... *F15B 15/103* (2013.01); *D04B 1/102* (2013.01); *D04B 1/22* (2013.01);
(Continued)

(58) Field of Classification Search
CPC .. D04B 1/22; D04B 1/102; D04B 2403/0241; F15B 15/103; F15B 2215/305
See application file for complete search history.

(56) References Cited

U.S. PATENT DOCUMENTS 10,363,670 B1 * 7/2019 Gundling ..... B25J 18/06
2007/0094937 A1 5/2007 Pedretti
(Continued)

FOREIGN PATENT DOCUMENTS

CN 101365854 A 2/2009
WO WO-2013130760 A2 9/2013

OTHER PUBLICATIONS

Ahlquist et al., "PneumaKnit: Actuated Architectures Through Wale- and Course-Wise Tubular Knit-Constrained Pneumatic Systems," ACADIA 2017: Disciplines & Disruption, Nov. 2017, pp. 38-51.

(Continued)

*Primary Examiner* — Thomas E Lazo
*Assistant Examiner* — Daniel S Collins
(74) *Attorney, Agent, or Firm* — Harness, Dickey & Pierce, P.L.C.

(57) ABSTRACT

A pneumatic textile system capable of transforming from a two-dimensional structure to a three-dimensional structure under pneumatic pressure is provided. The pneumatic textile system includes a seamless knit fabric having a grid configuration defining a plurality of grid areas—a first of the plurality of grid areas having a tensile strength that is different from a second of the plurality of grid areas. A pneumatic bladder member is disposed along at least a (Continued)

portion of a boundary between adjacent ones of the plurality of grid areas and is inflatable to exert a force on the seamless knit fabric, wherein upon inflation of the pneumatic bladder member the force is exerted on the seamless knit fabric such that the first of the plurality of grid area assumes a shape different than the second of the plurality of grid areas resulting in a three-dimensional structure transformation.

20 Claims, 17 Drawing Sheets

(52) U.S. Cl.
CPC .. *D10B 2403/0241* (2013.01); *D10B 2505/20* (2013.01); *F15B 2215/305* (2013.01)

(56) References Cited

U.S. PATENT DOCUMENTS

| | | | |
|---|---|---|---|
| 2010/0266796 | A1 | 10/2010 | Pedretti |
| 2014/0260436 | A1 | 9/2014 | Putta et al. |
| 2016/0075061 | A1 | 3/2016 | Waas et al. |

OTHER PUBLICATIONS

International Search Report and Written Opinion for PCT/US2018/012946, dated Jul. 5, 2018; ISA/KR.

* cited by examiner

METHOD OF ACTUATION USING KNIT-CONSTRAINED PNEUMATICS

CROSS-REFERENCE TO RELATED APPLICATIONS

This application is a U.S. National Phase Application under 35 U.S.C. 371 of International Application No. PCT/US2018/012946 filed on Jan. 9, 2018. This application is based on and claims the benefit of U.S. Provisional Application No. 62/443,938, filed on Jan. 9, 2017. The entire disclosures of all of the above applications are incorporated herein by reference.

FIELD

The present disclosure relates to pneumatic actuation and, more particularly, relates to a method of actuation using knit-constrained pneumatics.

BACKGROUND AND SUMMARY

This section provides background information related to the present disclosure. This section also provides a general summary of the disclosure, and is not a comprehensive disclosure of its full scope or all of its features, which is not necessarily prior art.

The present teachings disclose a seamless transformable material system through an interdependent designed assembly of two materials with different material properties (anisotropic knit textile and isotropic silicone) but similar behaviors (stretch). The transformable system is achieved by balancing the volumetric expansion through a silicone tube, under inflation, with the controlled resistance to stretch by a custom knit fabric comprising different yarns and knit structures. The use of a computer numerical control (CNC) knitting machine allows not only an opportunity to program the stretch behavior of a knit fabric, by controlling the combination of yarn materials and the variation of stitch types, but also an ability to knit multiple layers of fabric simultaneously, in order to create a space capable of accommodating an external element seamlessly. The present teachings disclose a series of experiments ranging from the initial search for compatible material combinations to the varied structures of the tube sleeve and its relationship with surrounding region. The final design utilizes the various behavioral properties of the material system learned from the experiments to create a transformable three-dimensional structure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1A:
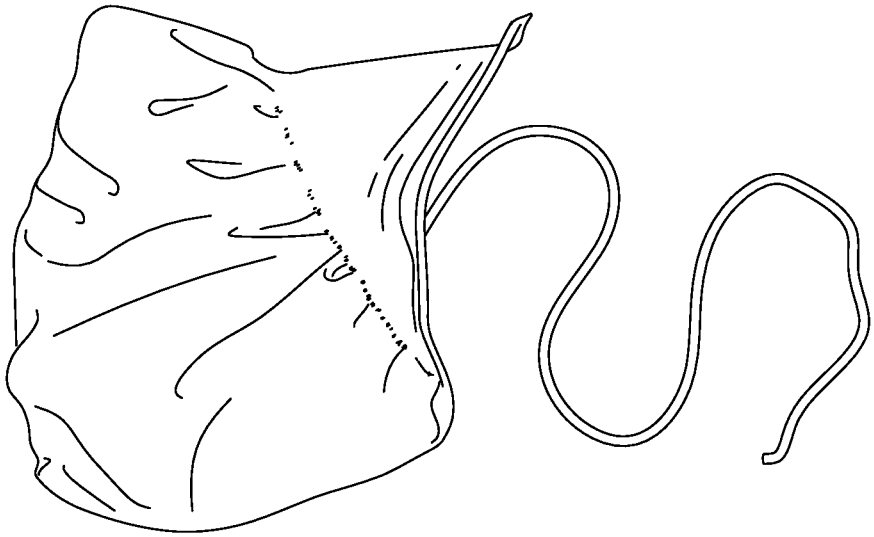
FIG. 1A illustrates an unstretched knit textile according to the principles of the present teachings.
Figure 1B:
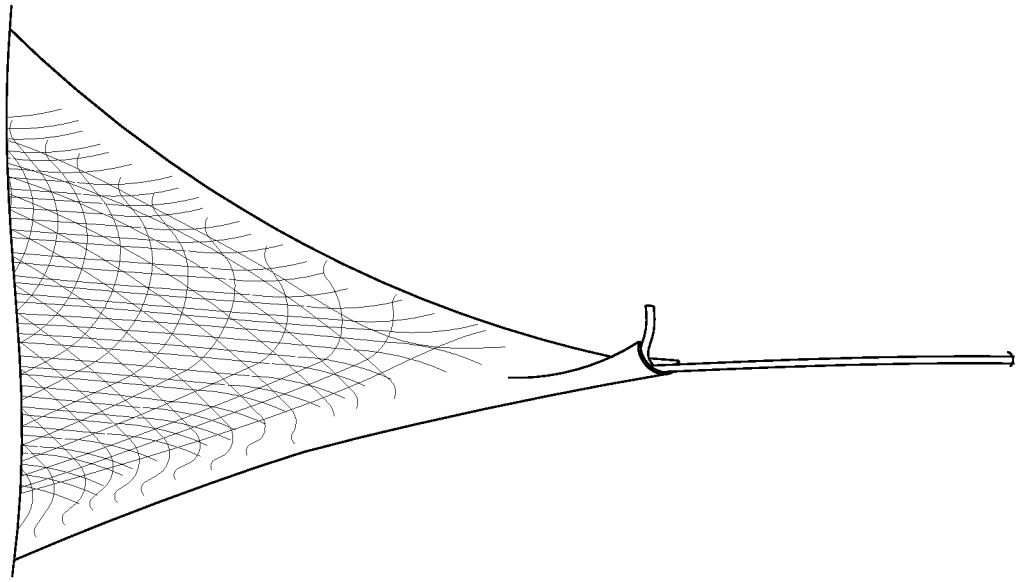
FIG. 1B illustrates a stretched knit textile according to the principles of the present teachings.
Figure 2:
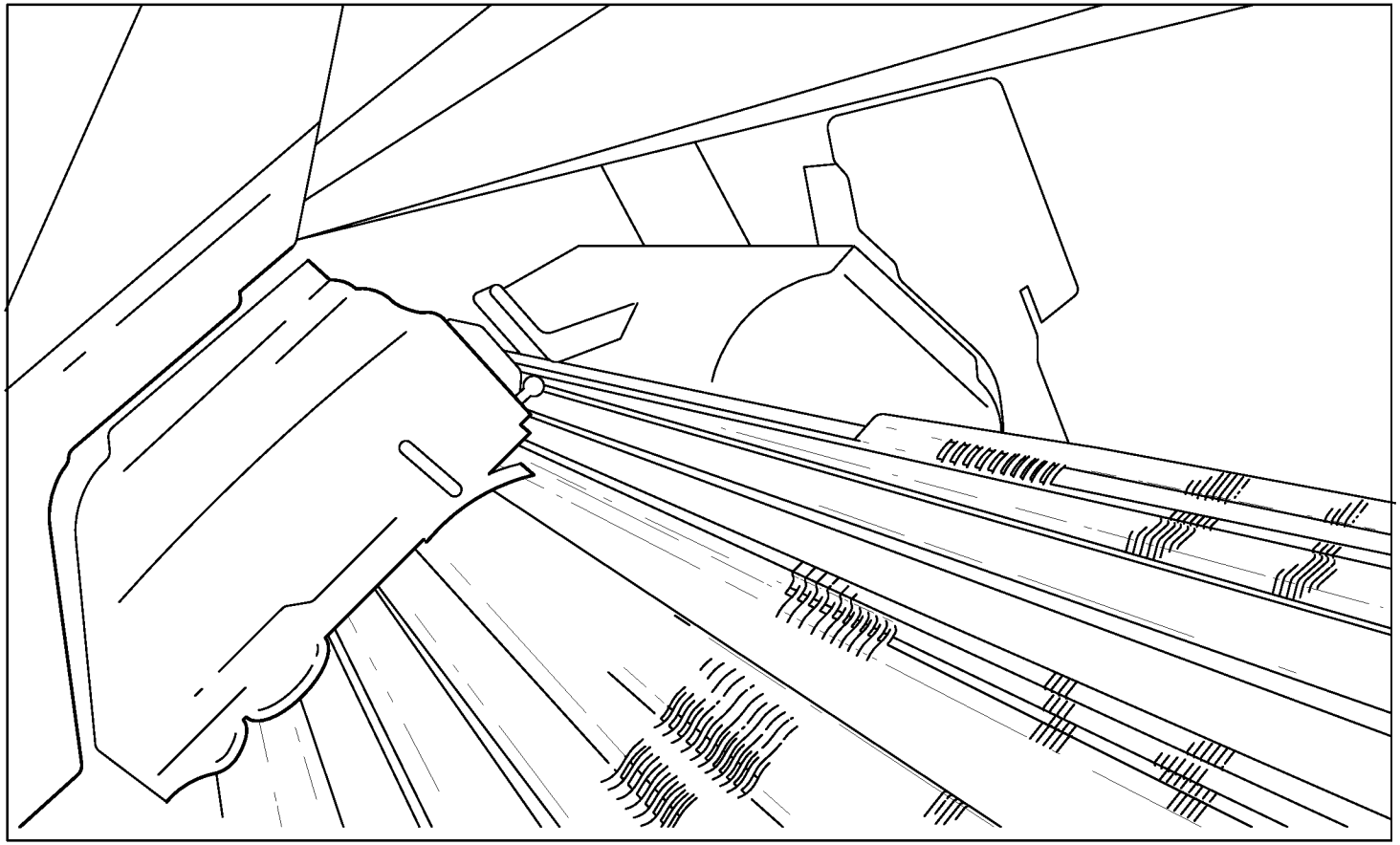
FIG. 2 illustrates inversed V-beds of needles of STOLL knitting machine according to the principles of the present teachings.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

"Material System" is described as an interdependent assembly of materials based on their innate properties with an intention to create a desired material behavior instead of a preconceived geometric form. A basic material system example would be a knit fabric where the process of interlock-looping of a yarn transforms the yarn's initial linear tensile nature to an expanded field condition.

This invention concerns the assembly of a programmable anisotropic knit fabric material with an isotropic silicone tube to create a deployable and three-dimensional (3D) transformable structure. When inflated, the expansion of the silicone tube will stretch the knit textile. When taut, the knit textile will limit the degree of expansion by the silicone tube. Together, the two form an interdependent material system. The present teachings contributes to the future development of textile-related design in the field of architecture by successfully demonstrating the ability of custom-knit fabric to seamlessly accommodate an external element without a secondary aggregation process, such as sewing, and the ability to program a desired behavior into the textile to create a true 3D structure.

BACKGROUND

Similar to traditional knitting, CNC weft knitting is the process of laying a continuous piece of yarn onto a bed of needles to form interlocking loops. In the case of a STOLL knitting machine, there are two flat beds of needles arranged in an inversed v-shape with yarn feeders running on top. The needles are raised to catch the yarns as the feeders move past them. The gauge of a machine refers to the number of needles per inch. In advanced knitting, it may sometimes be required to knit on every other needle, leaving an empty needle in between; this is called half gauging. The empty needle provides the additional space needed for transferring of needles to create a complex knit pattern and multiple layers. The needle activation is controlled numerically by codes generated from the graphic interface M1 plus, where the designer can assign the exact location of needles to catch the passing yarn feeders, and other parameters such as stitch type, stitch length, and stitch transfers.

Under stress, a knit fabric typically redistributes the load along one axis more than the other due to the composition of yarns and fibers and the asymmetry of the interlocking loops. The process of CNC knitting allows an opportunity to either exaggerate or diminish the difference in force distribution through custom-knit stitch structures that either increase the stretch of fabric by more loosely arranging the yarn or increase the stretch resistance by more densely compacting the yarn. Varied stiffness in the knit structure is also accomplished through the integration of differentiated yarns. The result of localized differentiated properties within the prototype knit textile becomes more evident when activated by a uniformly expanding silicone tube, as the volume of inflation is directly affected by the willingness or resistance of the surrounding fabric to stretch.

Figure 3A:
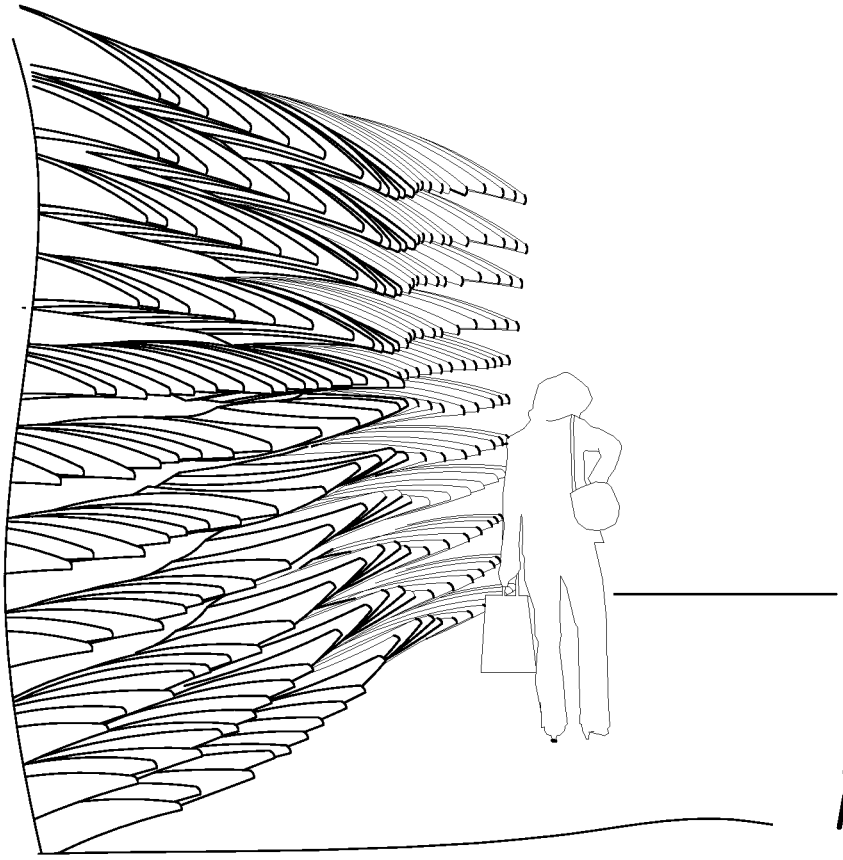
Fig-3A PRIOR ART
FIGS. 3A and 3B illustrate "Soft Robotics Applied to Architecture," (Kim et al. 2015) in a closed and opened position, respectively.
Figure 3B:
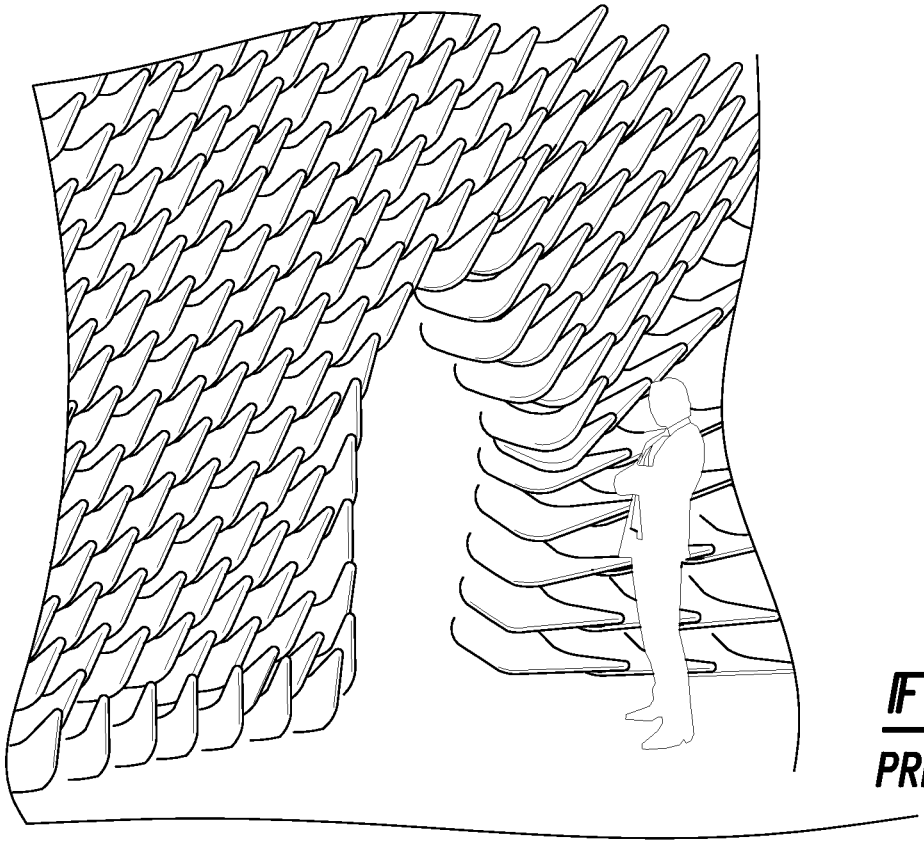
Fig-3B PRIOR ART

In "Soft Robotics Applied to Architecture" as illustrated in FIG. 3, Kim et al. attempt to add a layer of intelligence to inflatable architecture by integrating soft actuated surfaces, such as walls, ceilings, or floors. Motion sensors are planted to detect the presence of occupants and trigger actuation of the pneumatic fixtures that, in return, create an opening in the wall. The soft surfaces are actuated through pneumatic inflation. The differentiated movement under inflation is achieved through custom ribs in the inflated bladder or varied thickness in the silicone membrane. In this context, pneumatics are an efficient means of generating movement in the silicone cell. The invention demonstrates the potential for dynamic movements in an architectural surface through differentiated inflation by the custom-knit structures.

Figure 4A:
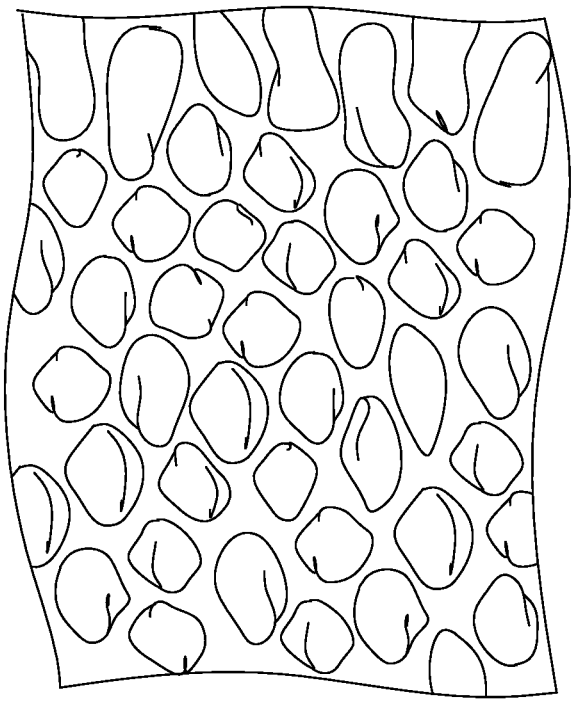
Fig-4A PRIOR ART
FIGS. 4A and 4B illustrate "Listener," (Thomsen et al. 2009) in a top view and bottom view, respectively.
Figure 4B:
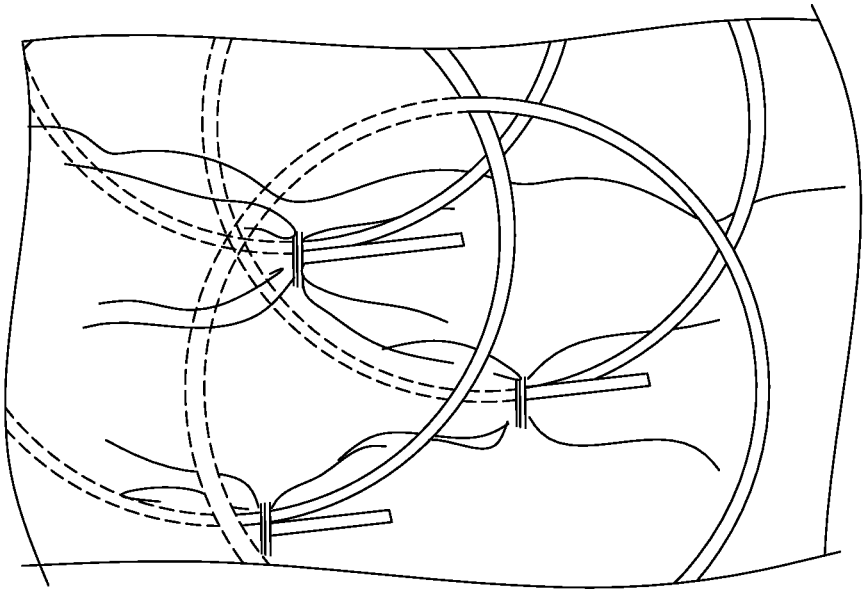
Fig-4B PRIOR ART

In "Listener" as illustrated in FIG. 4, Thomsen et al. examine the integration of conductive fibers within the textile matrix to enable sensing. Using capacitive sensing, the textile membrane becomes an interface for interaction. This is then combined with an actuation system of integrated high-pressure bladders that allow the material to inflate. The "Listener" takes advantage of the CNC knitting process to integrate three types of yarn (polyethylene for over structure, elastomer for stretch, and silver-coated for conduction) to create a custom textile that, when paired with a microprocessor, becomes a self-sensing interactive material system. Sensors were planted and inflatable bladders were inserted into individual cells to create an interface that allowed the system to respond to its environment. In this context, the fabric serves as both the interactive interface and host to the sensory system.

Method

The approach of the present teachings to develop a single seamless inflatable 3D structure can be divided into four categories and is illustrated and described in connection with FIGS. 1-26. The first stage is the selection of compatible materials for the pneumatic textile system 10. The second stage is to investigate the relationship between the knit sleeve 12 and the enclosed silicone tube 14. The knit sleeve 12 needs to accommodate the size increase of the inflated tube 14 with a relatively inelastic yarn, while maintaining enough density variation with the use of an elastic yarn to create the desired direction of bending without overstressing the silicone material of tube 14. The third stage is considering the surface regions surrounding the planted tube 14. As the tube 14 expands, it will stretch the fabric of knit sleeve 12 around it. Differentiated density of yarn distribution can be tested to find the appropriate tensile strength to accommodate the expansion of the tube 14. Finally, the fourth stage include knitting multiple layers of fabric at the same time permit 3D actuation and break away from the typical 2D nature of a textile.

Figure 5:
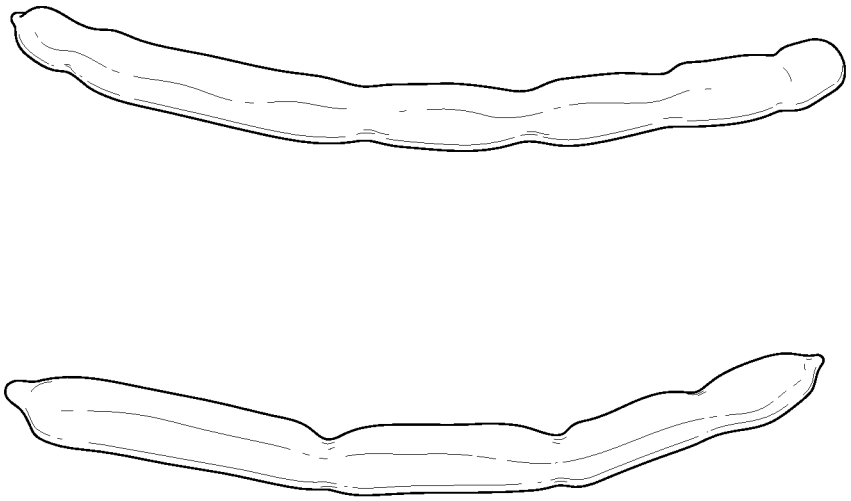
FIG. 5 illustrates latex balloon and nylastic sleeve according to the principles of the present teachings.
Figure 6:
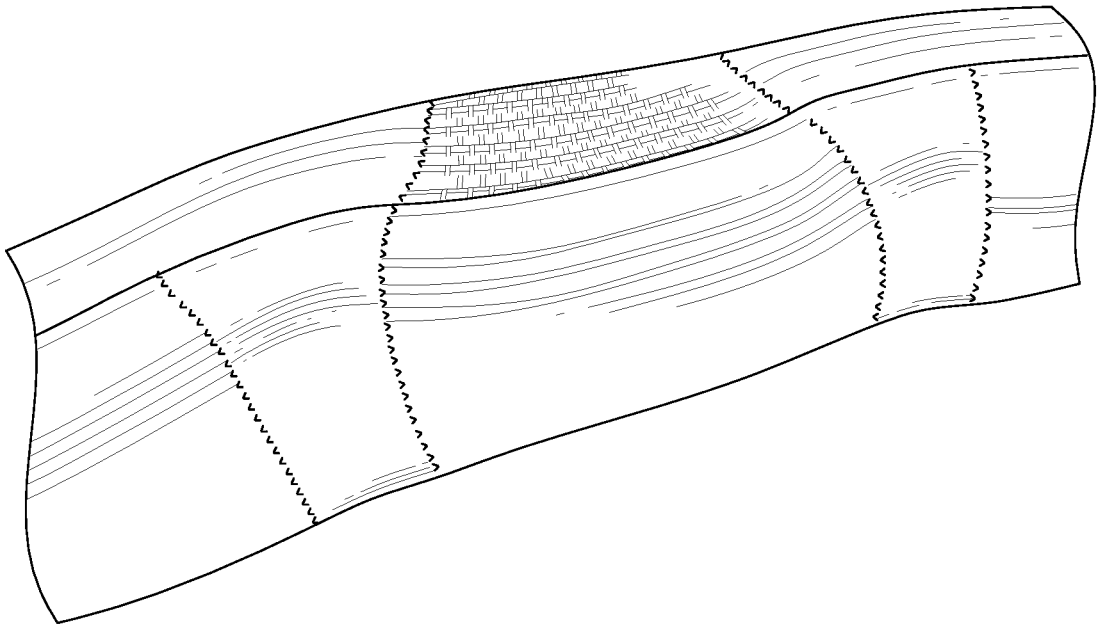
FIG. 6 illustrates rubber tube and nylastic sleeve according to the principles of the present teachings.

The first stage of the research relating to the present invention focused on the search for compatible textile sleeve and inflation bladder material. The first attempt used latex balloon and nylastic sleeve. Despite the light weight and relative thin gauge of the nylastic yarn, it produced too much friction for successful inflation of the latex balloon inside. The membrane of the latex balloon was very thin, and the friction from the fabric blocked air flow within it. Even with water-based lubricants or soap, smooth continuous inflation was not possible and resulted in a sausage-like effect, as shown in FIG. 5. The second half of the first stage substituted the latex balloon with segmented bicycle inner tube. Continuous inflation was achieved, but the nylastic sleeve failed to provide consistent direction of planned bending due to lack of resistance to overall tube, as shown in FIG. 6.

Figure 7:
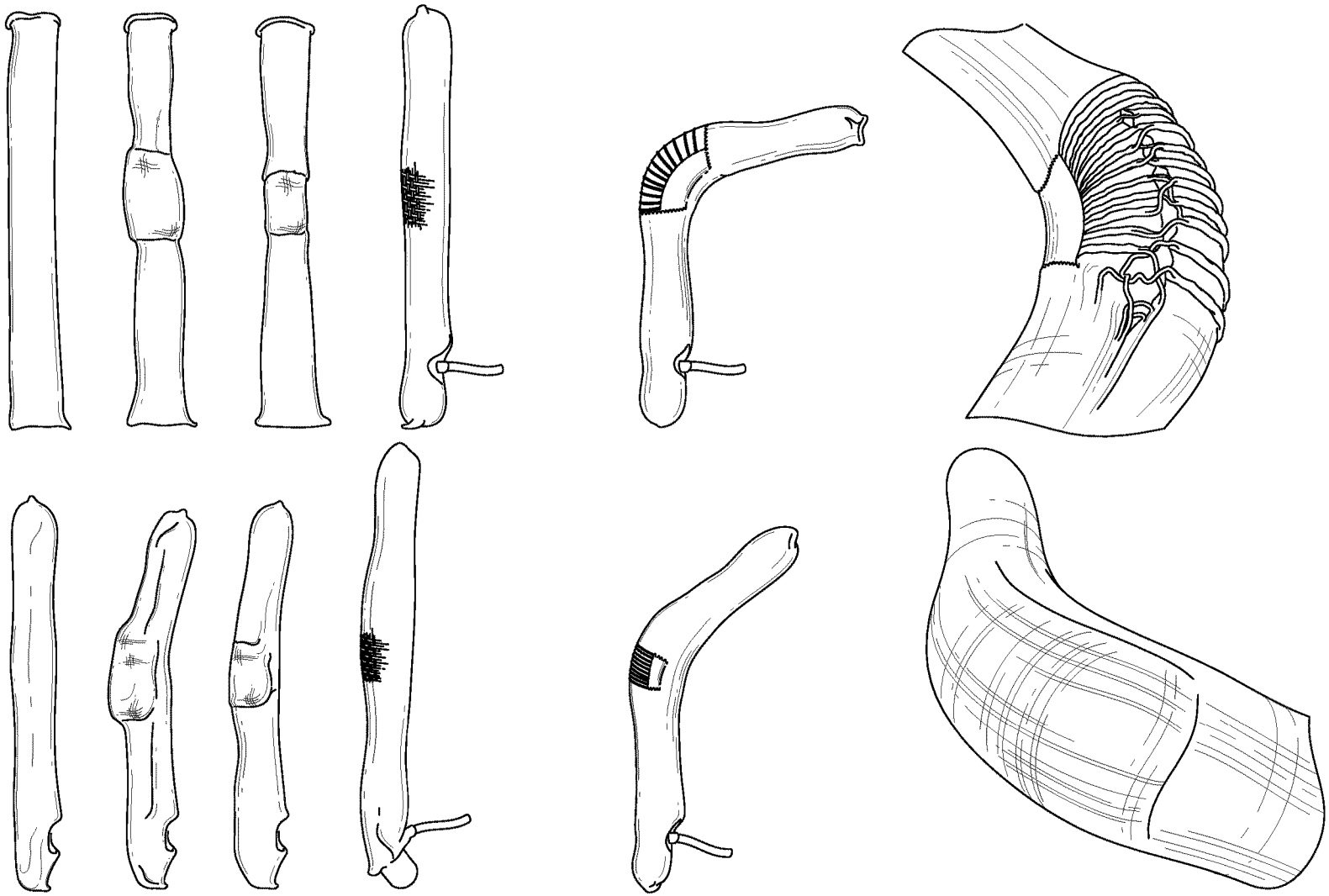
FIG. 7 illustrates bending tests according to the principles of the present teachings.

The second stage used polyester yarn as main material for the inflatable housing. It proved to be consistent in initiating the desired direction of bending. If the knit structure was loose on the top half of the sleeve and tight on the bottom half, the inflated tube would bend downward as the top half would be stretched more. The degree of bending could even be exaggerated with the introduction of nylastic yarn at selected locations, as shown in FIG. 7.

Figure 8A:
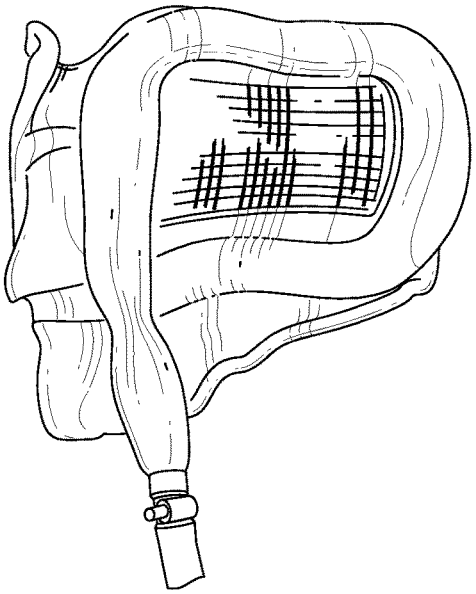
FIGS. 8A and 8B illustrate regional tests according to the principles of the present teachings.
Figure 8B:
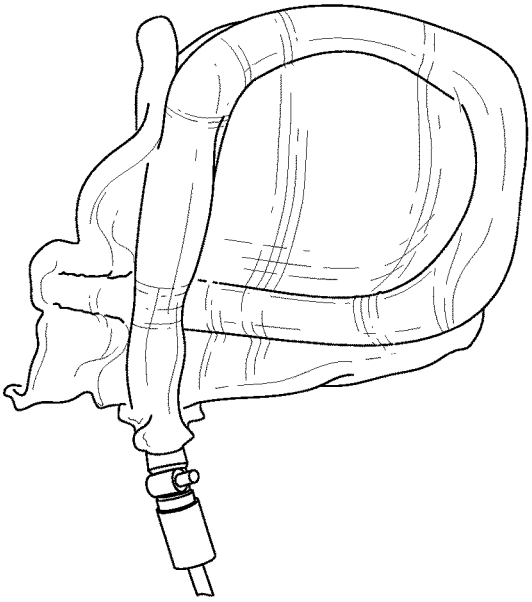

The third stage focused on the interaction of the surrounding surface area by the inflated tube 14. FIGS. 8A and 8B show that without a custom-knit structure, the inflated tube boundary would expand evenly in a circular manner. With the introduction of alternate miss stitches, every missed stitch reduced the loop length of the fabric to stretch and therefore limited the expansion of the tube boundary to a rectangular manner.

Figure 9:
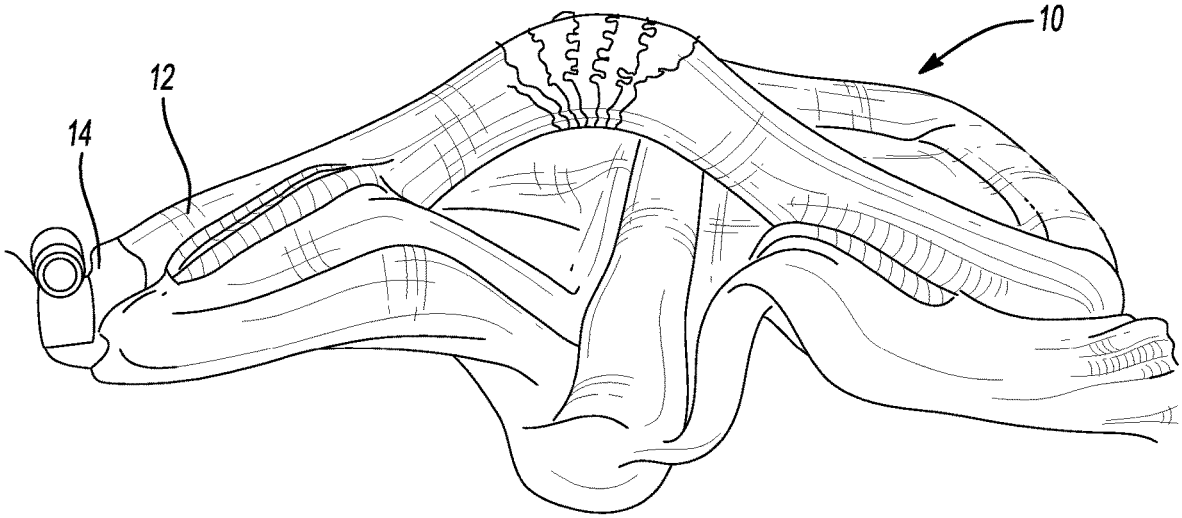
FIG. 9 illustrates a 3D bridge according to the principles of the present teachings.
Figure 10:
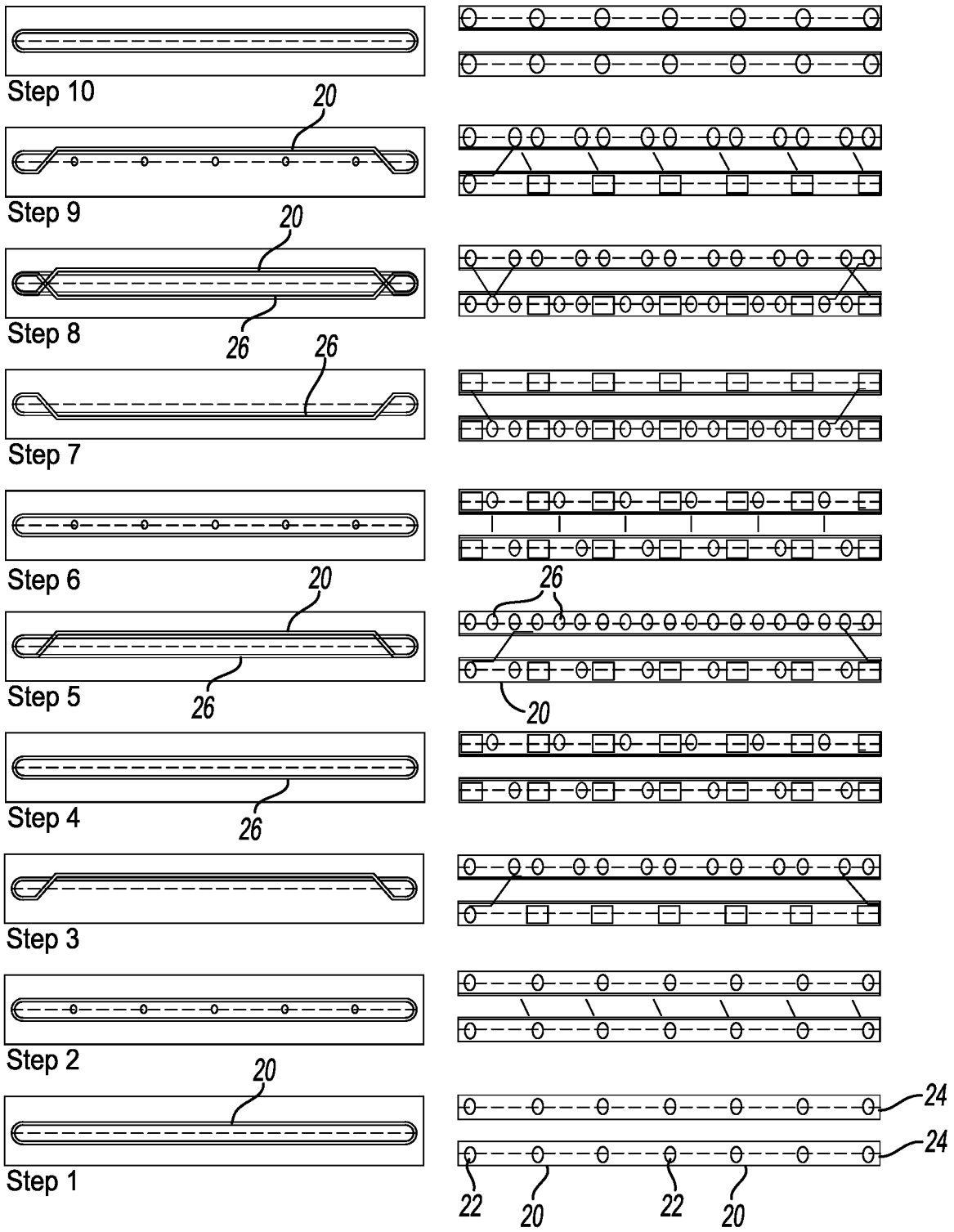
FIG. 10 illustrates a diagram for the knit program according to the principles of the present teachings.
Figure 11:
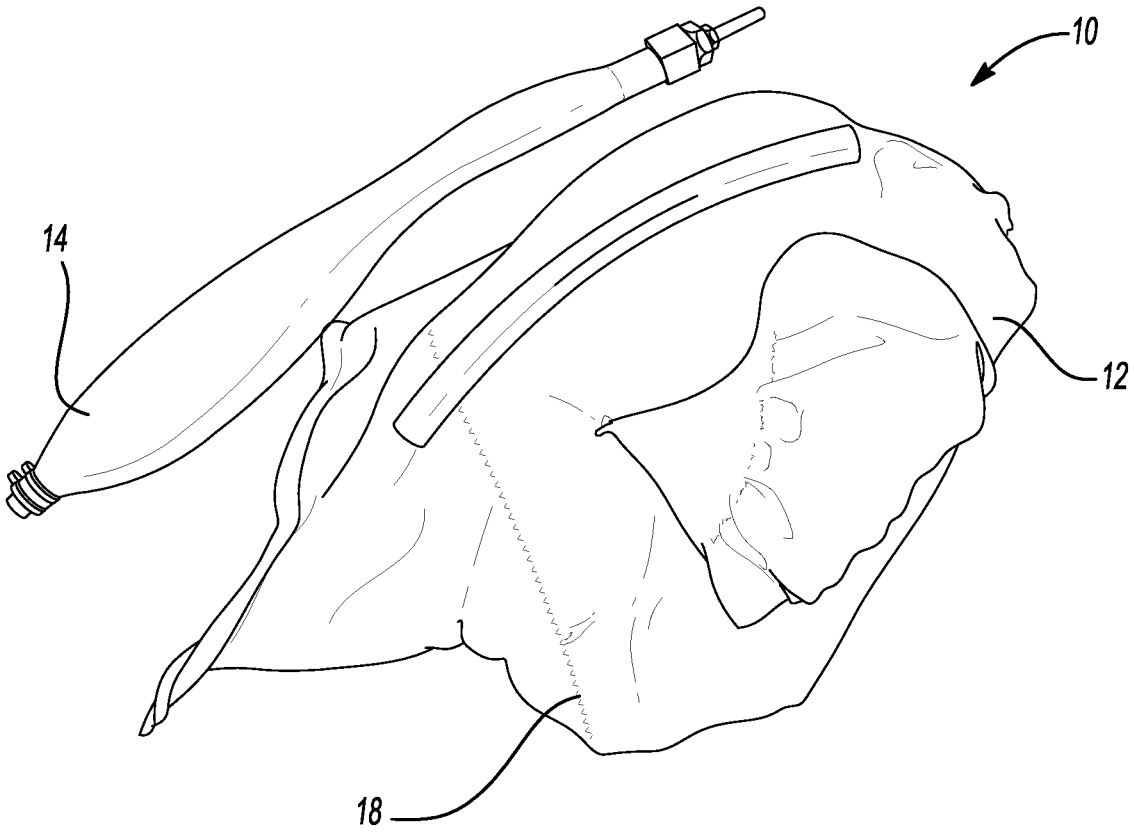
FIG. 11 illustrates prototype materials according to the principles of the present teachings.

The fourth stage focused on ways of ensuring the 3D quality of the design. FIG. 9 shows the transformative quality of the layered textile with a bridge-like tube 14 breaking away from the 2D plane. Multiple layer knitting is done by providing additional empty needles for transferring. FIG. 10 diagrams the sequencing of needle assignments to achieve multiple layers of free fabric that can share the same area on the knitting machine. Step 1 shows a loop of yarn 20 occupying every third needle 22 on both beds 24. Steps 2 and 3 show how the yarn is transferred from front to back to be deactivated. Step 4 shows the introduction a new independent yarn 26 and step 5 shows the location of yarn 26 relative to the yarn 20. Steps 6 and 7 show the deactivation of yarn 26 by transferring from back to front, while step 8 shows that the machine is now housing both yarn 20 and yarn 26 in four layers of fabric 12. Step 9 shows the transferring of yarn 20 from back to front again to be reactivated, and step 10 shows the start of cycle.

Results

Figure 12:
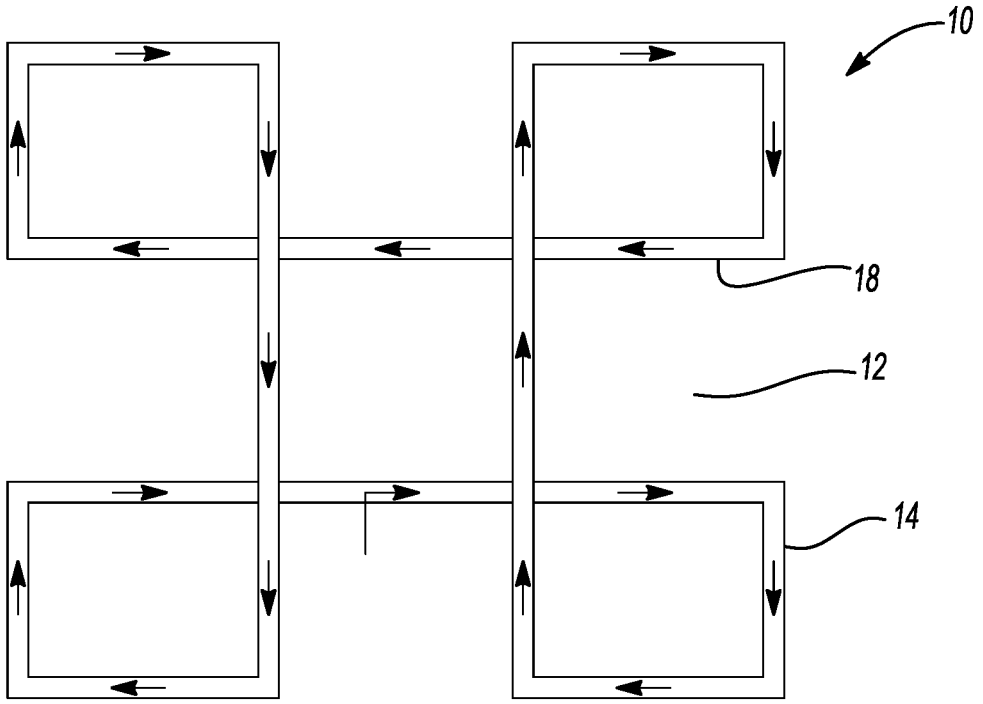
FIG. 12 illustrates tube location according to the principles of the present teachings.
Figure 13:
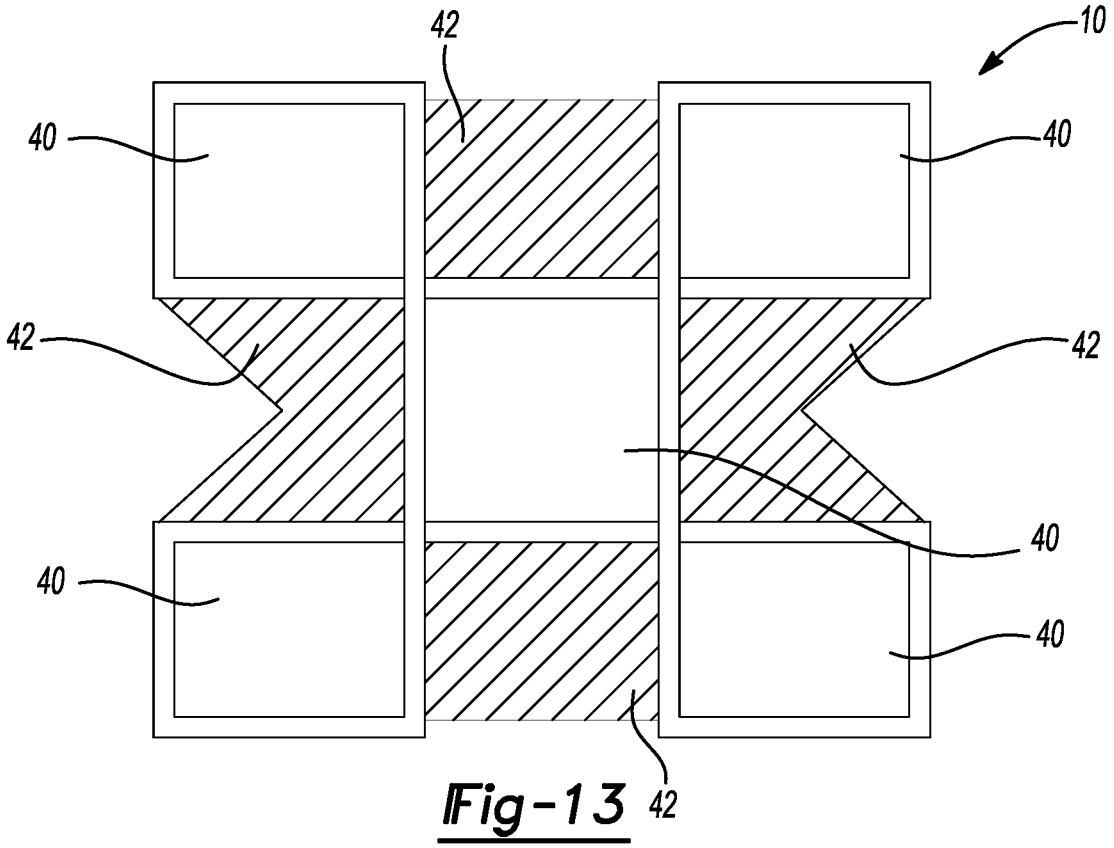
FIG. 13 illustrates 3×3 grid divisions according to the principles of the present teachings.

The design 10 is an assembly of ½ inch internal diameter (⅝ external diameter) silicone tube 14, as the inflatable bladder (FIG. 11), inserted into a seamless custom CNC knit fabric 12, with the tube house 18 dividing the textile into a 3×3 grid configuration (FIG. 12). The diagonal rectangles of the 3×3 grid, marked as 40, in FIG. 13, are high tensile zones of densely knit stitches that have limited stretch in both x and y axes. The four middle rectangles 42 on the outer boundary (FIG. 13) are medium-tensile zones with alternate miss stitches that create limited stretch in the x axis only. When inflated, the 3×3 grid boundary area of the tube is allowed for maximum expansion in volume, in order to activate the stretching of the fabric in the various zones. The resistance created by the stretching of the fabric will in return trigger a three-dimensional transformation.

There are three sets of prototypes: A.1 (see FIGS. 15-16), A.2 (see FIGS. 17-18), and B.1 (see FIGS. 19-21). Prototype A.1 is the 3×3 grid with emphasis on the 3D arching bridges as a means of bending to actuate the 3D transformation. Prototype A.2 is a duplicate of two sets of A.1 in one seamless textile. The lengths of the 3D bridges are varied in an attempt to differentiate the degree of deformation. Prototype B.1 is similar to A.1 but has an extended layer of fabric from the edges of the 3D bridges in an attempt to generate a pocket space between layers of fabrics.

Figure 14:
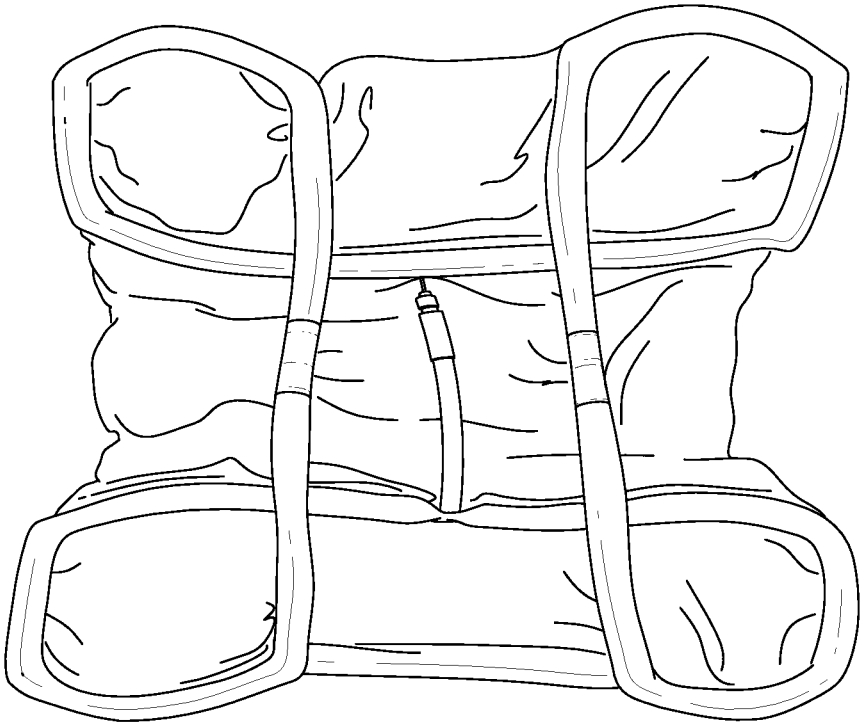
FIG. 14 illustrates an inflated prototype without successful 3D transformation.
Figure 15:
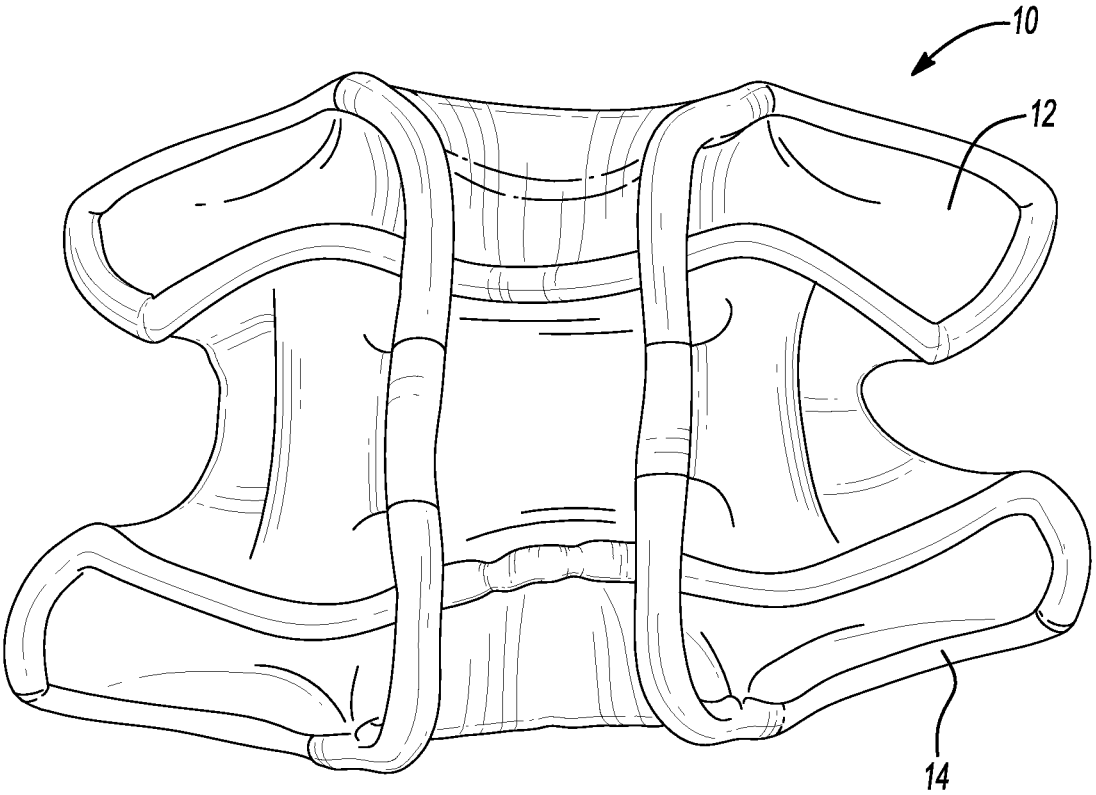
FIG. 15 illustrates top view of prototype A.1 according to the principles of the present teachings.
Figure 16:
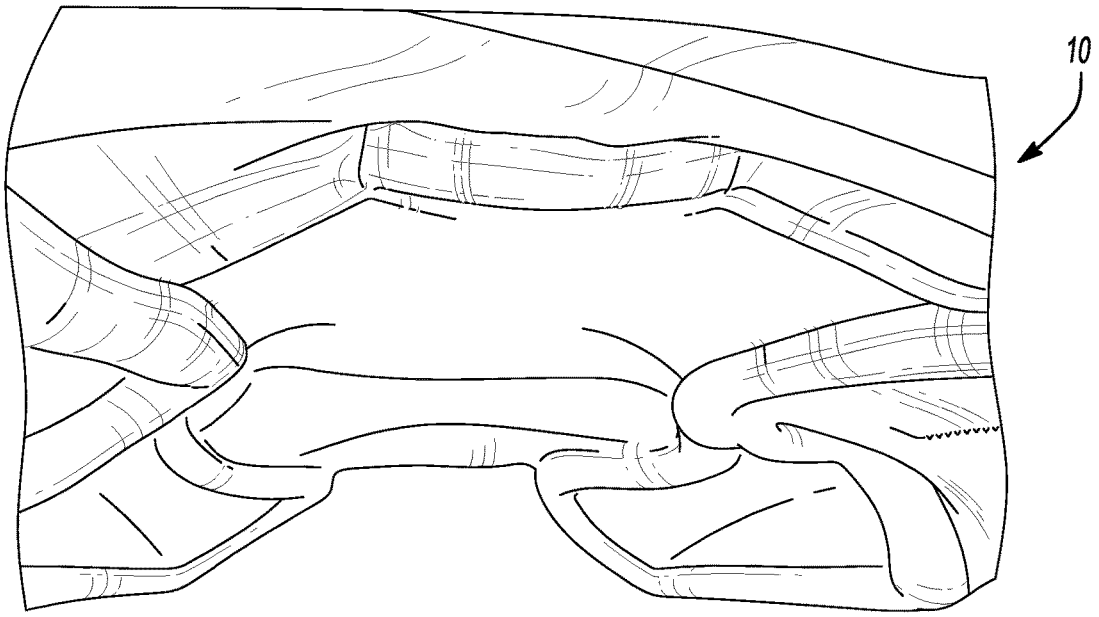
FIG. 16 illustrates interior view of prototype A.1 according to the principles of the present teachings.
Figure 17:
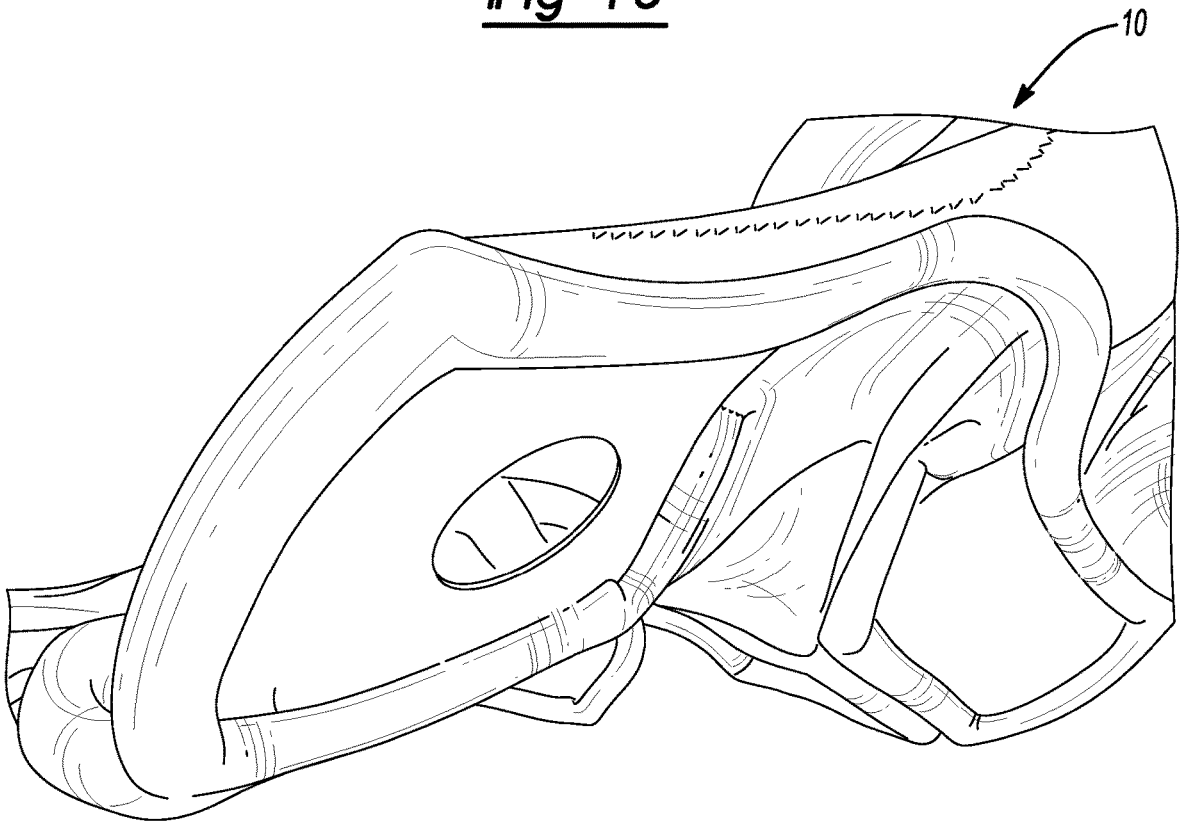
FIG. 17 illustrates interior view of prototype A.2 according to the principles of the present teachings.
Figure 18:
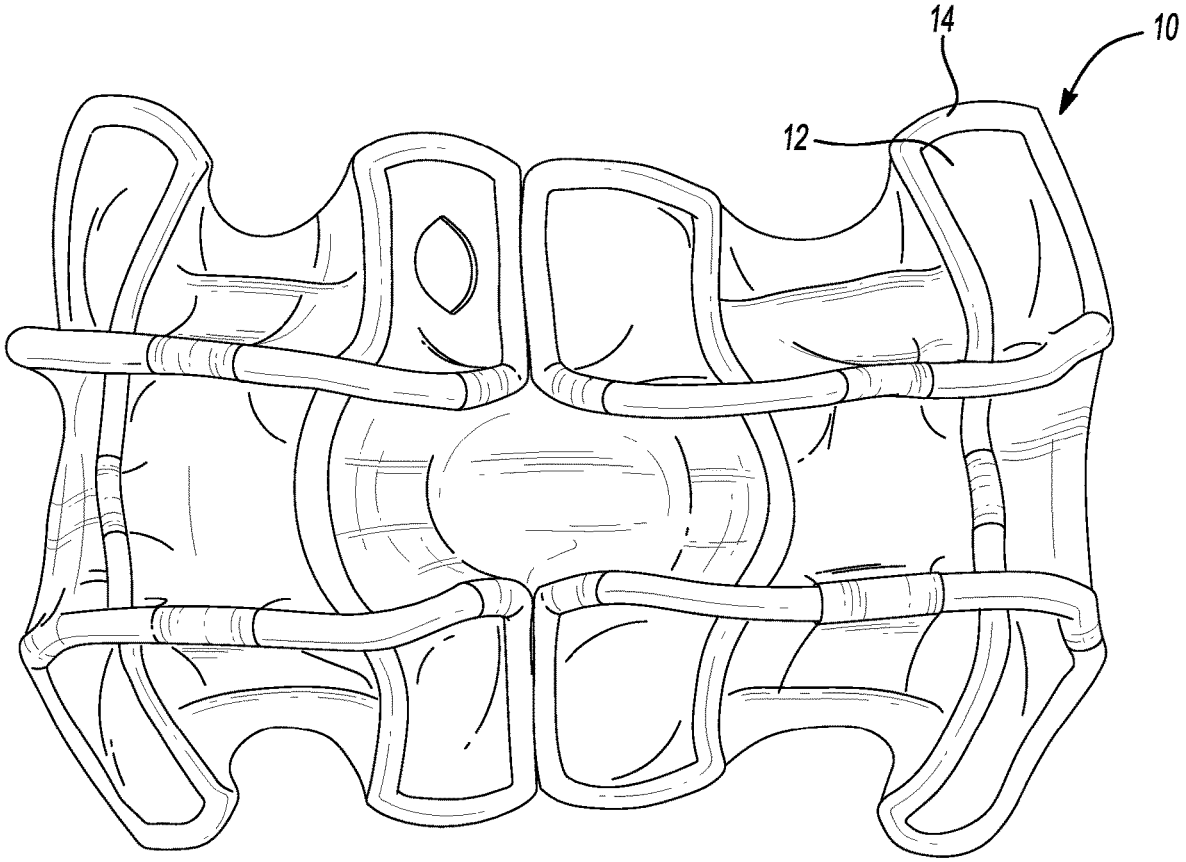
FIG. 18 illustrates top view of prototype A.2 according to the principles of the present teachings.
Figure 19:
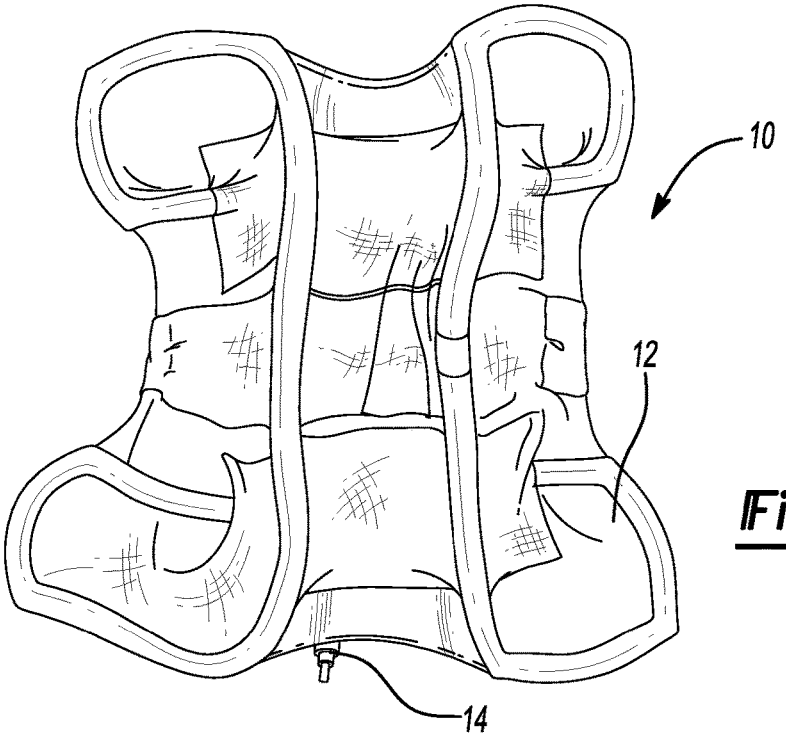
FIG. 19 illustrates top view of prototype B.1 according to the principles of the present teachings.

The initial results of these inflated prototypes without the implementation of custom-knit structures reveal success in hosting the inflated bladder, but a failure to create significant 3D transformation (FIG. 14). After adjusting the knit structure by reducing stitches (materials) in the webbed region to increase the tightness in the fabric, all three adjusted prototypes are able to successfully transform from the original 2D set up to a 3D structure. Without the knit sleeve 12, the silicone tube 14 usually shows signs of overstress at approximately 16 psi of pressure by becoming more opaque, but it maintains its integrity inside the knit sleeve to pressures of up to 40 psi without any color change. At approximately 30 psi, the inflated tube shows significant stiffness to support the knit textile lifting parts of the assembly off the ground. It is clear that the original straight orthogonal 3×3 grid design transforms under inflation to curvilinear forms.

Prototype A.1 and A.2 demonstrate the effect of the bridging arches in the bending of the overall structure. The longer the bridge, the more bending forces are exerted at the anchoring points.

Figure 20:
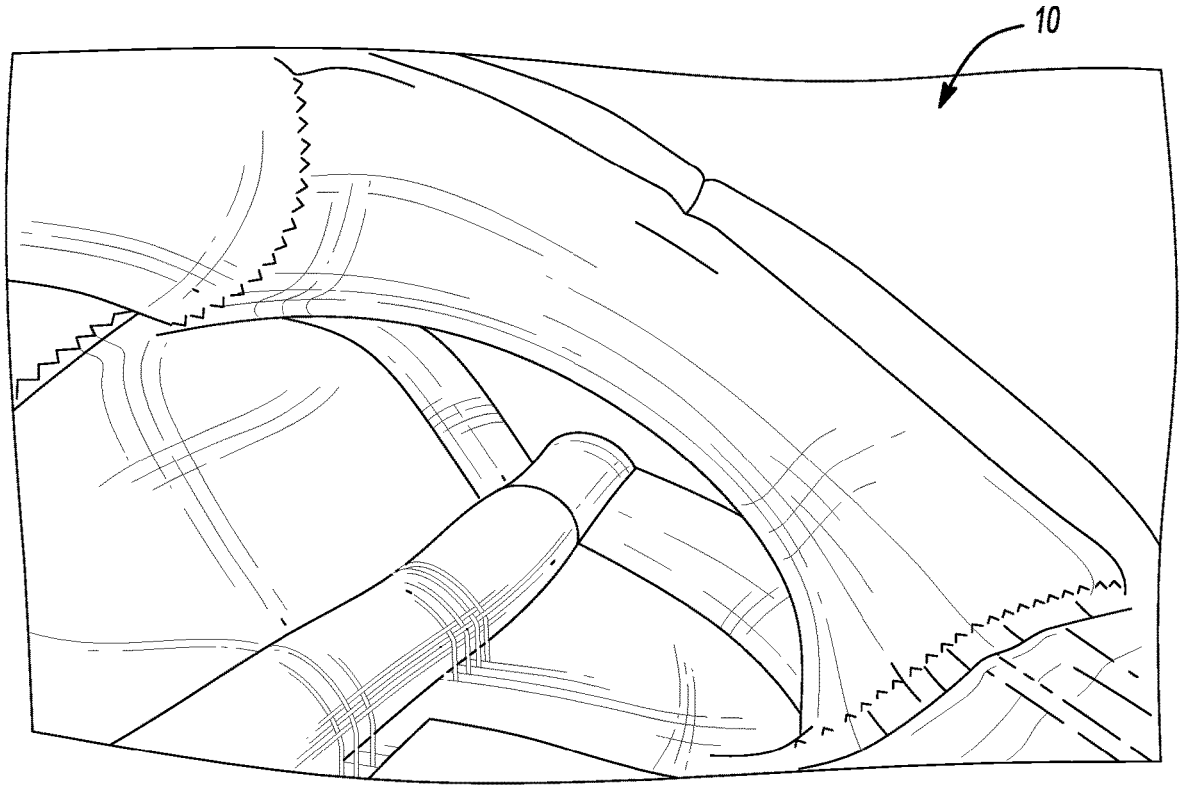
FIG. 20 illustrates external layering of prototype B.1 according to the principles of the present teachings.
Figure 21:
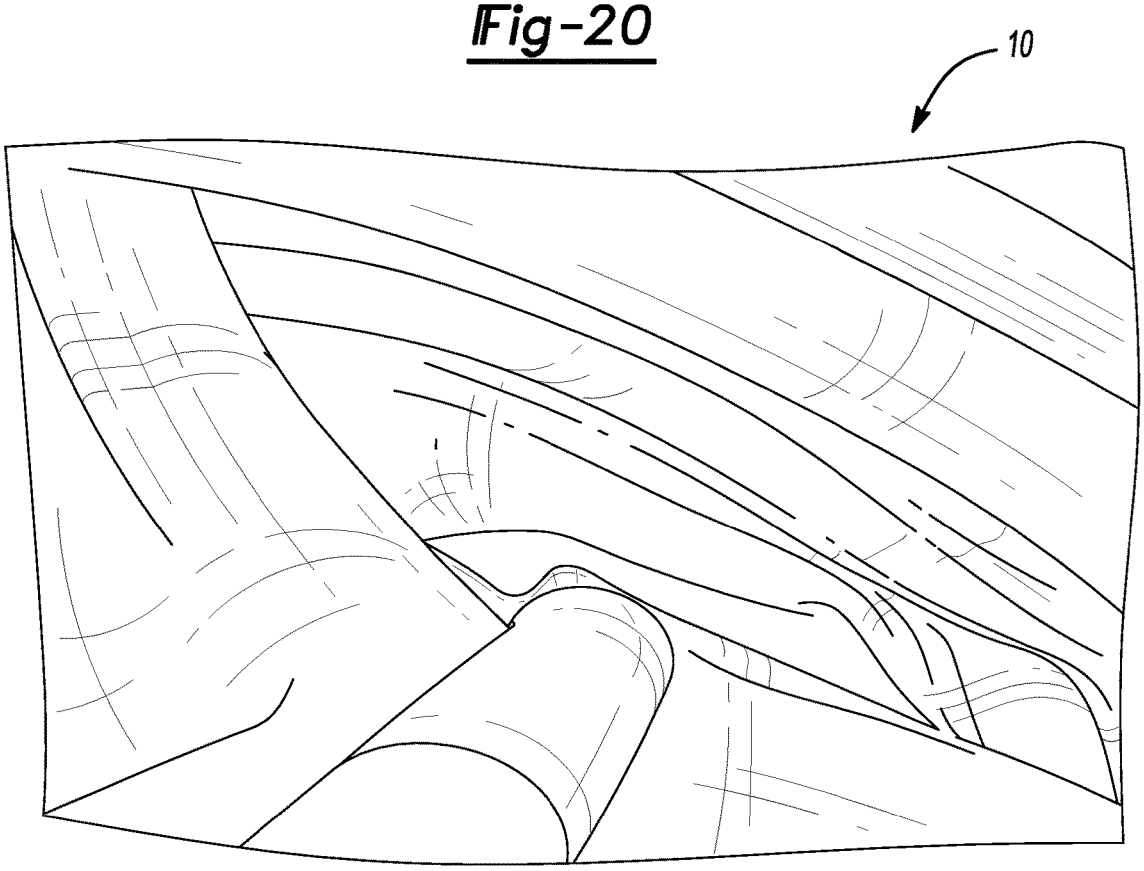
FIG. 21 illustrates internal layering of prototype B.1 according to the principles of the present teachings.

Prototype B.1 shows how the varied knit structures not only have effects on the tensile behavior of the fabric, but also the transparency of the overall structure (FIG. 20).

Computation

The study initially used Kangaroo and Maya Cloth to simulate the pneumatic textile system, but both packages focused on simulation of fabric behavior as a uniform soft body without addressing the possibility of a differentiated structural behavior within the fabric and the continuity of the original linear yarn. Therefore, the project decided to mimic the behavior of the design structure in Maya through the systematic use of cluster deformers.

Figure 22:
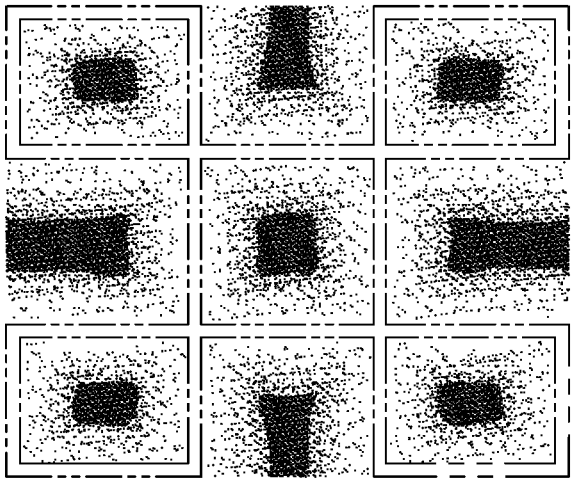
FIG. 22 illustrates a uniform scaling (inflation) map according to the principles of the present teachings.
Figure 23:
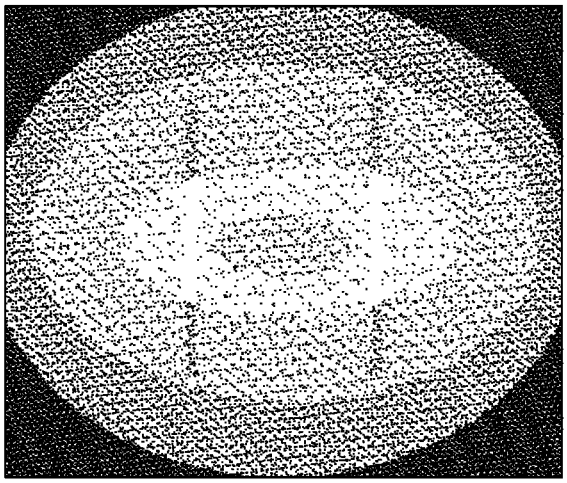
FIG. 23 illustrates an upward push (lift) map according to the principles of the present teachings.
Figure 24:
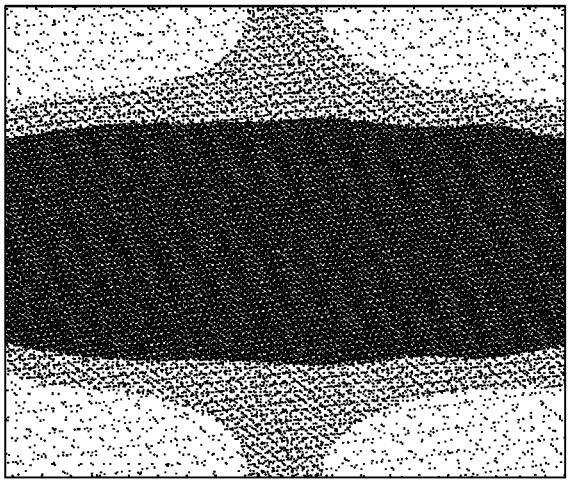
FIG. 24 illustrates a downward sag (gravity) map according to the principles of the present teachings.
Figure 25:
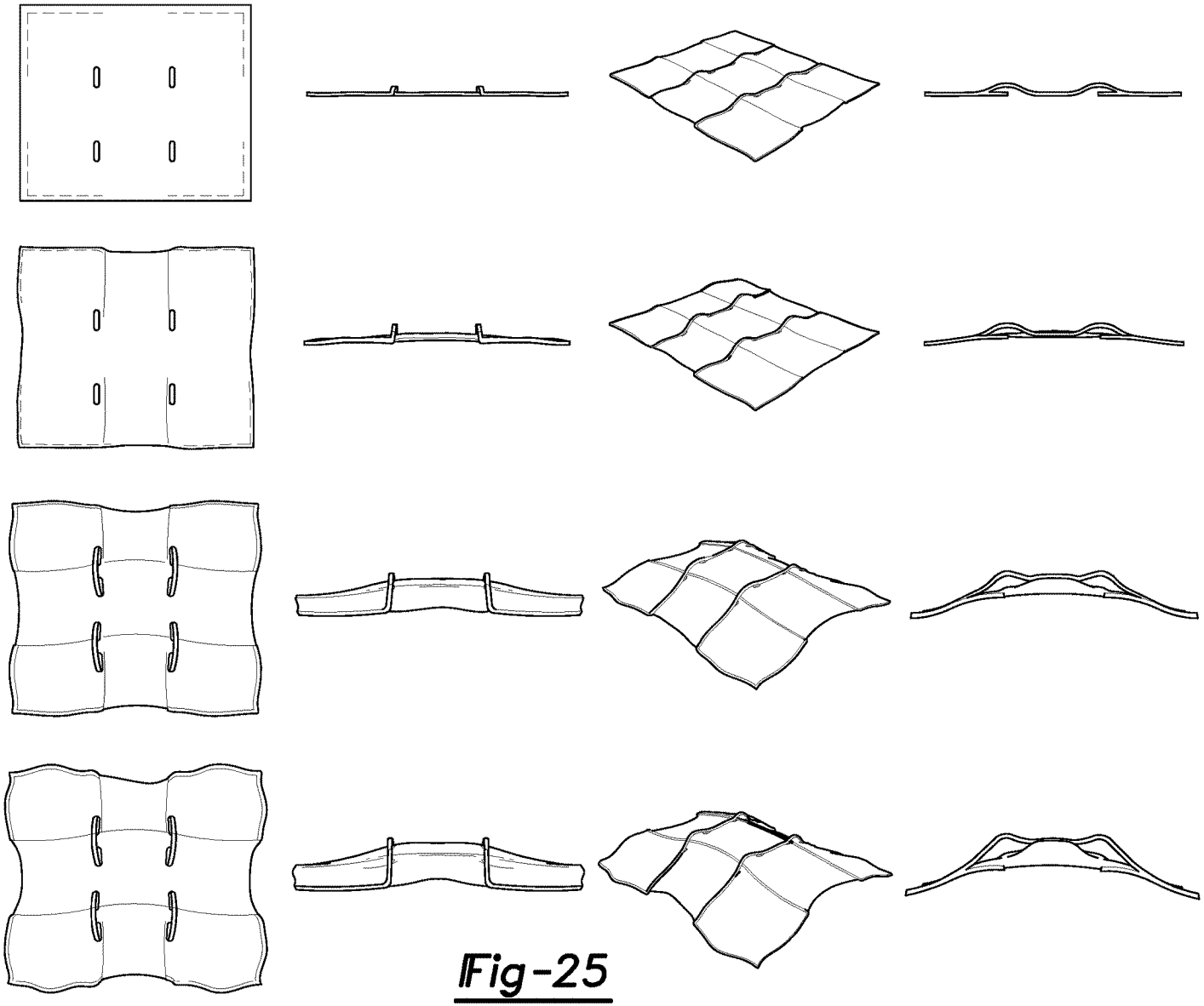
FIG. 25 illustrates pneumatic simulations with cluster deformer according to the principles of the present teachings.
Figure 26:
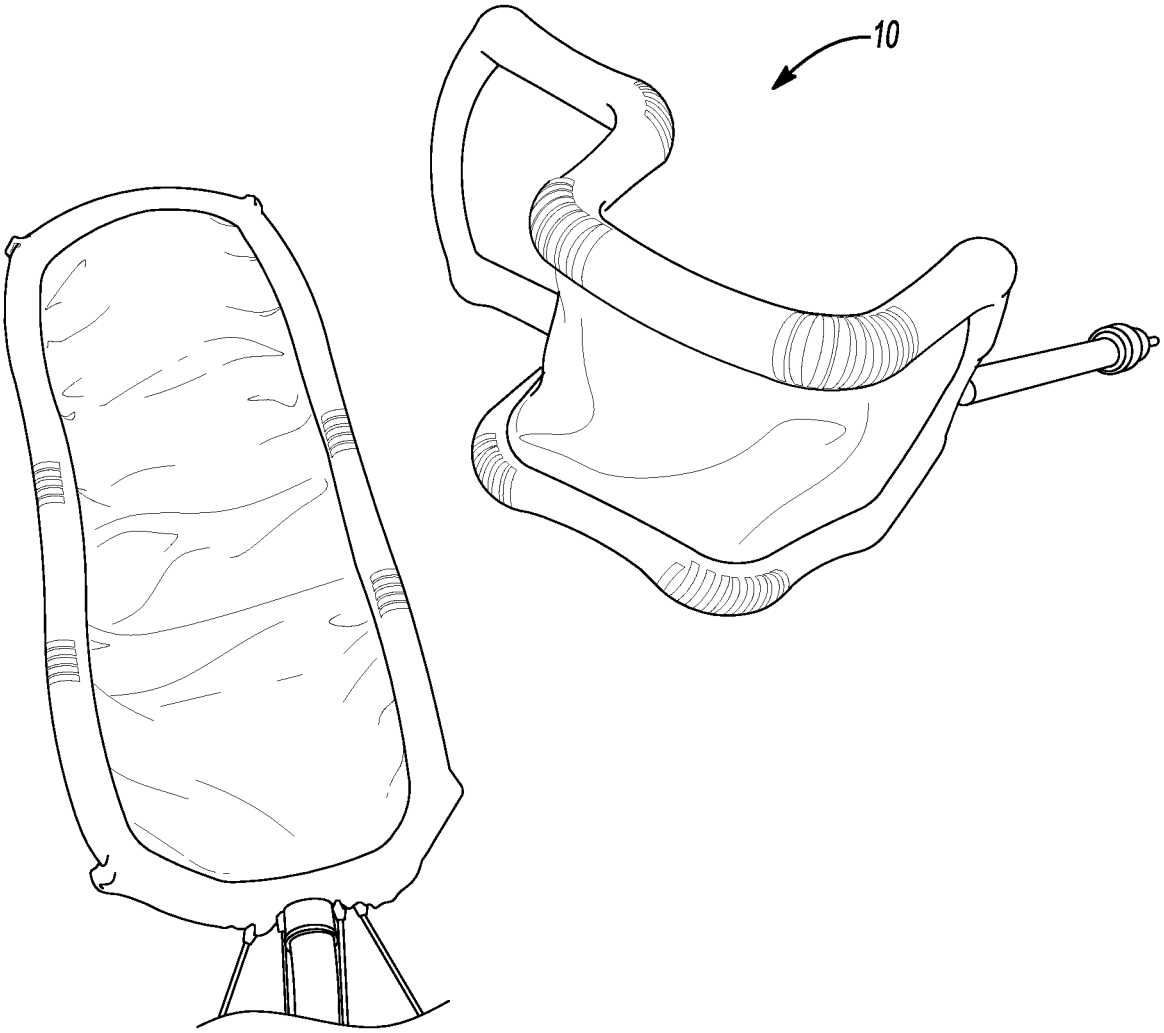
FIG. 26 illustrates a photographic view of the knit textile according to the principles of the present teachings.

A geometric model is created in Maya and a cluster deformer is later applied. The cluster deformers generate uniform scaling similar to inflation and effect vertical movement similar to gravitational force. Assigning varied weights to the individual vertices in the geometric model, differentiated mesh movements are generated in response to the same uniform scaling or vertical movements by the cluster deformer. The weight of the deformer is scaled 0.000 to 1.000 and is applied to an individual vertex through a graphic interface of "painting" that has 255 levels of grey (white to black) to mimic the dissipation of the tensile forces. Three clusters are used to simulate inflation (uniform scaling), upward movement by expanding tube (+Z axis translation), and gravitational pull (−Z axis translation). FIG. 22 shows the inflation map were areas of the tube location are at the 100% effective range (white color) of the cluster. The tube area then gradually dissipates toward the center of each rectangle into shades of grey. FIG. 23 shows areas of the prototype that will be propped upward during the expansion of the inflating tube. FIG. 24 shows the downward drag around the outer edges due to weight of the prototype. FIG. 25 shows the pneumatic simulations with cluster deformer according to the principles of the present teachings. FIG. 26 illustrates a photographic view of the knit textile according to the principles of the present teachings.

CONCLUSION

The prototypes demonstrate the ability of custom knitting to integrate external elements to form a transformative material system. However, the process of textile design requires many rounds of trial and error until the desired behavior is achieved. The knit textile design process is actually suited for computational design because either the "knit" or "miss" conditions of knitting are similar to the binary conditions of 1 or 0. Computing will resolve the different shades of grey between black and white similar to the way that knit fabric redistributes its applied forces. FIG. 22 attempts to show how areas of different fabric density respond differently to the stretch caused by the same inflated tube. The tedious task of measuring the individual stitch spacing will eventually lead to the rendering of mathematical equations that describe the force dissipation by the linear yarn of the fabric. Data gathered from the analogue model can feed into the design of a more accurate computational model.

Immediate advancements in the pneumatic textile system can be obtained with more experiments with different yarn materials, different geometric patterns of bladder inflation implementation, or even the use of the custom textile as soft formworks, since casting plaster or concrete can lead to stretching in a manner similar to inflation.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A pneumatic textile system capable of transforming from a two-dimensional structure to a three-dimensional structure under pneumatic pressure, the pneumatic textile system comprising:

a seamless knit fabric having a grid configuration defining a plurality of grid areas, a first of the plurality of grid areas having a tensile strength that is different from a second of the plurality of grid areas; and a pneumatic bladder member disposed along at least a portion of a boundary between adjacent ones of the plurality of grid areas, the pneumatic bladder member being inflatable to exert a force on the seamless knit fabric, wherein upon inflation of the pneumatic bladder member the force is exerted on the seamless knit fabric such that the first of the plurality of grid area assumes a shape different than the second of the plurality of grid areas resulting in a three-dimensional structure transformation, wherein the pneumatic bladder member is disposed within a tube house slot extending along the boundary between said adjacent ones of the plurality of grid areas.

2. The pneumatic textile system according to claim 1 wherein the plurality of grid areas are configured to include diagonal grid areas having a tensile zone greater than at least one of a remaining grid area.

3. The pneumatic textile system according to claim 1 wherein the first of the plurality of grid areas has limited stretch capability in both x and y axes directions.

4. A pneumatic textile system capable of transforming from a two-dimensional structure to a three-dimensional structure under pneumatic pressure, the pneumatic textile system comprising:

a seamless knit fabric having a grid configuration defining a plurality of grid areas, a first of the plurality of grid areas having a tensile strength that is different from a second of the plurality of grid areas; and a pneumatic bladder member disposed along at least a portion of a boundary between adjacent ones of the plurality of grid areas, the pneumatic bladder member being inflatable to exert a force on the seamless knit fabric, wherein upon inflation of the pneumatic bladder member the force is exerted on the seamless knit fabric such that the first of the plurality of grid area assumes a shape different than the second of the plurality of grid areas resulting in a three-dimensional structure transformation, wherein the first of the plurality of grid areas has alternate miss stitches resulting in limited stretch capability in only an x axis direction.

5. A pneumatic textile system capable of transforming from a two-dimensional structure to a three-dimensional structure under pneumatic pressure, the pneumatic textile system comprising:

a seamless knit fabric having a grid configuration defining a plurality of grid areas, a first of the plurality of grid areas having a tensile strength that is different from a second of the plurality of grid areas; and a pneumatic bladder member disposed along at least a portion of a boundary between adjacent ones of the plurality of grid areas, the pneumatic bladder member being inflatable to exert a force on the seamless knit fabric, wherein upon inflation of the pneumatic bladder member the force is exerted on the seamless knit fabric such that the first of the plurality of grid area assumes a shape different than the second of the plurality of grid areas resulting in a three-dimensional structure transformation, wherein the seamless knit fabric is configured to include miss stitches that affect the stretch capability of the fabric.

6. The pneumatic textile system according to claim 1 wherein the seamless knit fabric is made of polyester yarn.

7. A pneumatic textile system capable of transforming from a two-dimensional structure to a three-dimensional structure under pneumatic pressure, the pneumatic textile system comprising:

a seamless knit fabric having a grid configuration defining a plurality of grid areas, a first of the plurality of grid areas having a tensile strength that is different from a second of the plurality of grid areas; and a pneumatic bladder member disposed along at least a portion of a boundary between adjacent ones of the plurality of grid areas, the pneumatic bladder member being inflatable to exert a force on the seamless knit fabric, wherein upon inflation of the pneumatic bladder member the force is exerted on the seamless knit fabric such that the first of the plurality of grid area assumes a shape different than the second of the plurality of grid areas resulting in a three-dimensional structure transformation, wherein the seamless knit fabric is made of a combination of polyester and nylastic yarn where the nylastic yarn is utilized to accentuate the degree of bending when inflated.

8. The pneumatic textile system according to claim 1 wherein the first of the plurality of grid areas has alternate miss stitches resulting in limited stretch capability in only an x axis direction.

9. The pneumatic textile system according to claim 1 wherein the seamless knit fabric is configured to include miss stitches that affect the stretch capability of the fabric.

10. The pneumatic textile system according to claim 4 wherein the pneumatic bladder member is disposed within a tube house slot extending along the boundary between said adjacent ones of the plurality of grid areas.

11. The pneumatic textile system according to claim 4 wherein the plurality of grid areas are configured to include diagonal grid areas having a tensile zone greater than at least one of a remaining grid area.

12. The pneumatic textile system according to claim 4 wherein the first of the plurality of grid areas has limited stretch capability in both x and y axes directions.

13. The pneumatic textile system according to claim 4 wherein the seamless knit fabric is made of polyester yarn.

14. The pneumatic textile system according to claim 5 wherein the pneumatic bladder member is disposed within a tube house slot extending along the boundary between said adjacent ones of the plurality of grid areas.

15. The pneumatic textile system according to claim 5 wherein the plurality of grid areas are configured to include diagonal grid areas having a tensile zone greater than at least one of a remaining grid area.

16. The pneumatic textile system according to claim 5 wherein the first of the plurality of grid areas has limited stretch capability in both x and y axes directions.

17. The pneumatic textile system according to claim 5 wherein the seamless knit fabric is made of polyester yarn.

18. The pneumatic textile system according to claim 7 wherein the pneumatic bladder member is disposed within a tube house slot extending along the boundary between said adjacent ones of the plurality of grid areas.

19. The pneumatic textile system according to claim 7 wherein the plurality of grid areas are configured to include diagonal grid areas having a tensile zone greater than at least one of a remaining grid area.

20. The pneumatic textile system according to claim 7 wherein the first of the plurality of grid areas has limited stretch capability in both x and y axes directions.

* * * * *